US005737998A

United States Patent [19]

Wang

[11] Patent Number: 5,737,998

[45] Date of Patent: Apr. 14, 1998

[54] HEAVY-LOAD HYDRAULIC OR AIR CYLINDER

[76] Inventor: Chiu Nan Wang, No. 50, Alley 97, Lane 354, Sanher Road, Fengyuan City, Taichung County, Taiwan

[21] Appl. No.: 791,651

[22] Filed: Nov. 25, 1996

[51] Int. Cl.[6] ..... F01B 11/02

[52] U.S. Cl. ..... 92/85 B; 92/85 A; 92/85 R

[58] Field of Search ..... 92/85 R, 85 A, 92/85 B, 143

[56] References Cited

U.S. PATENT DOCUMENTS

| | | | |
|---|---|---|---|
| 3,465,650 | 9/1969 | Gluck | 92/85 R |
| 4,206,687 | 6/1980 | Klaus et al. | 92/85 R |
| 4,211,150 | 7/1980 | Framberg | 92/85 R |
| 4,700,611 | 10/1987 | Kaneko | 92/85 B |
| 5,213,024 | 5/1993 | Huber et al. | 92/85 R |
| 5,228,380 | 7/1993 | Stoll et al. | 92/85 B |

FOREIGN PATENT DOCUMENTS

| | | | |
|---|---|---|---|
| 1435858 | 11/1988 | U.S.S.R. | 92/85 B |

*Primary Examiner*—Thomas E. Denion

*Attorney, Agent, or Firm*—Pro-Techtor International

[57] ABSTRACT

A heavy-load hydraulic or air cylinder comprises a main body provided therein with an action rod having an driven end. The driven end is exerted on by the liquid or air pressure to actuate the action rod. The driven end is provided respectively on both sides thereof with a pressure bearing piece. The driven end and the pressure bearing piece are provided therebetween with a leakproof ring. The main body is further provided at the exit end thereof with at least one pressure bearing piece. The pressure bearing piece and an exit cap are provided therebetween with a leakproof ring. When the action rod is at work to bring about the pressure, the pressure bearing piece is acted on by the pressure, which is the transferred to act on the leakproof ring, which in turn generates the reaction force to act against the inner wall surface of the main body so as to enable the cylinder to withstand a heavy burden or weight.

4 Claims, 7 Drawing Sheets

HEAVY-LOAD HYDRAULIC OR AIR CYLINDER

FIELD OF THE INVENTION

The present invention relates generally to a hydraulic or air cylinder, and more particularly to a heavy-load hydraulic or air cylinder capable of withstanding a heavy burden or weight.

BACKGROUND OF THE INVENTION

As shown in FIG. 1 the conventional hydraulic or air cylinder comprises a main body 10, which is provided with two hydraulic or air holes 11 and an action rod 20 having one end 21 with a plurality of leak-preventing rings 22. The main body 10 is provided at the outlet end 12 thereof with a plurality of leak-preventing rings 22. The action rod 21 is actuated by the liquid or air injected into the end 21.

The hydraulic or air cylinder as described above is defective in design in that the action rod 21 is incapable of withstanding a heavy burden or weight, and that the leak-preventing righs 22 are susceptible to wear.

SUMMARY OF THE INVENTION

It is therefore the primary objective of the present invention to provide a heavy-load hydraulic or air cylinder, which comprises a main body provided therein with an action rod having a driven end. The driven end is exerted on by the liquid or air pressure to actuate the action rod. The driven end is provided respectively on both sides thereof with a pressure bearing piece. The driven end and the pressure bearing piece are provided therebetween with a leakproof ring by means of which a gap is provided between the pressure bearing piece and the driven end. The main body is provided at the exit end thereof with at least one pressure bearing piece. The exit cap and the pressure bearing piece are provided therebetween with a leakproof ring. When the action rod is at work to generate the pressure, the pressure bearing piece is acted on by the pressure. The pressure is then transferred to act on the leakproof ring, which is turn generates the reaction force acting against the inner wall of the main body so as to enable the cylinder to withstand a heavy burden or weight.

It is another objective of the present invention to provide a heavy-load hydraulic or air cylinder with an elastic piece disposed between the driven end of the action rod and the pressure bearing piece. The elastic piece is intended to promote the efficiency of the pressure bearing piece at the time when the cylinder is under a great pressure.

The leakproof rings of the cylinder of the present invention have a cross section, which may be round, square, wedge-shaped, rectangular, triangular, ect..

DETAILED DESCRIPTION OF THE INVENTION

Figure 1:
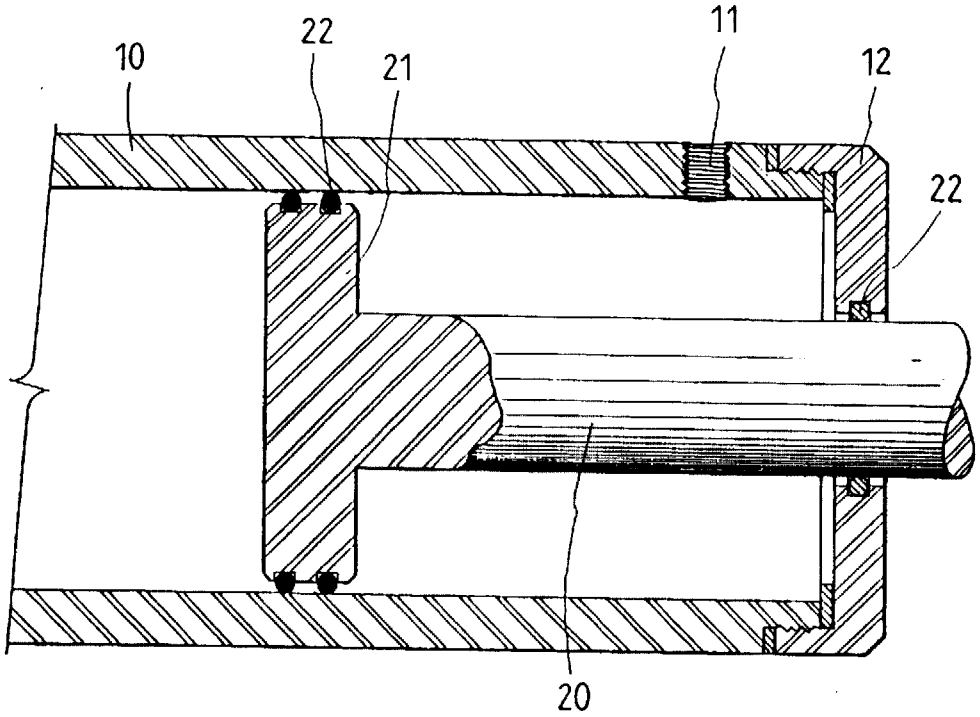
PRIOR ART FIG. 1
FIG. 1, shows a sectional view of a hydraulic or air cylinder of the prior art.
Figure 2:
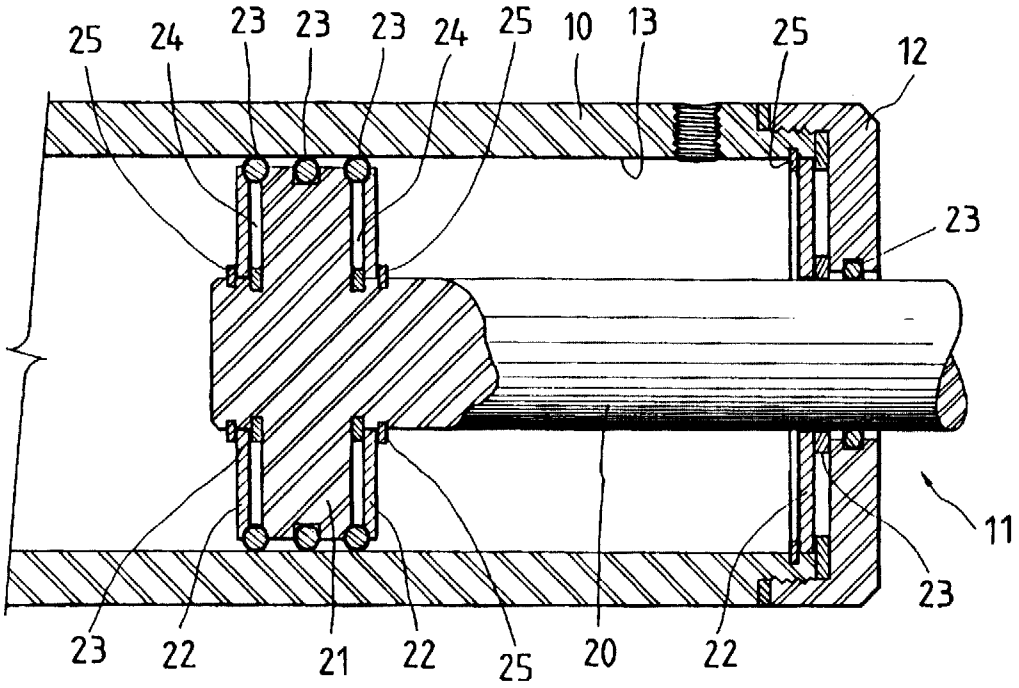
FIG. 2 shows a sectional view of a hydraulic or air cylinder of the present invention.

As shown in FIGS. 2–7, a heavy-load hydraulic or air cylinder embodied in the present invention is composed of a main body 10, which is provided therein with an action rod 20 having a driven end 21. The driven end 21 is capable of being driven by the hydraulic or air pressure to actuate the action rod 20 to move back and forth. The driven end 21 is provided respectively on both sides thereof with one or more pressure bearing piece 22. The pressure bearing piece 22 and the driven end 21 are provided therebetween with a leakproof ring 23, by means of which a gap 24 is formed between the pressure bearing piece 22 and the driven end 21. The pressure bearing piece 22 is located by means of a retaining piece 25. The main body 10 is further provided at an exit end 11 thereof with at least one pressure bearing piece 22, and an exit cap 12, and a leakproof ring 23 located between the pressure bearing piece 22 and the exit cap 12.

The action rod 20 is caused by the hydraulic or air pressure to move back and forth in the main body 10 such that the pushing force is generated. The pressure bearing piece 22 is acted on by the pushing force, which is in turn transferred to act on the leakproof ring 23. As the leakproof ring 23 is squeezed by the driven end 21 and the pressure bearing piece 22, the inner wall surface 13 of the main body 10 is exerted on by the reaction force of the leakproof ring 23. As a result, the action rod 20 is able to withstand a greater burden or weight.

Figure 3:
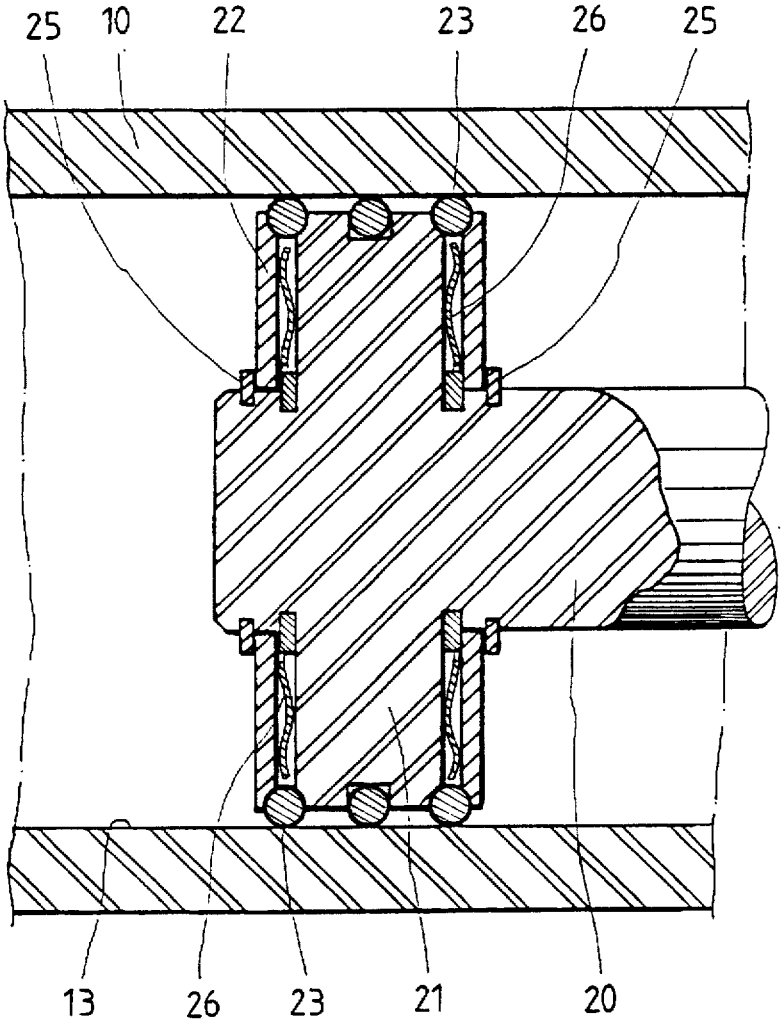
FIG. 3 shows another sectional view of the present invention.
Figure 5:
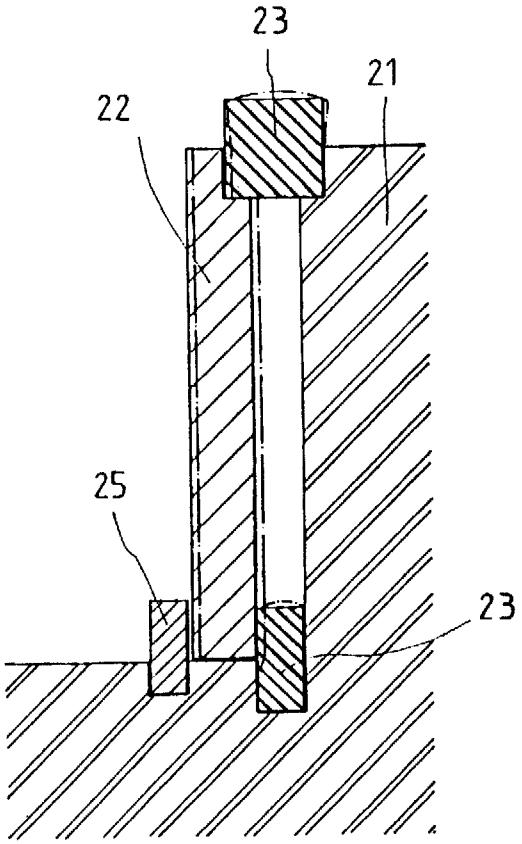
FIG. 5 shows another schematic view of the leakproof rings at work according to the present invention.
Figure 4:
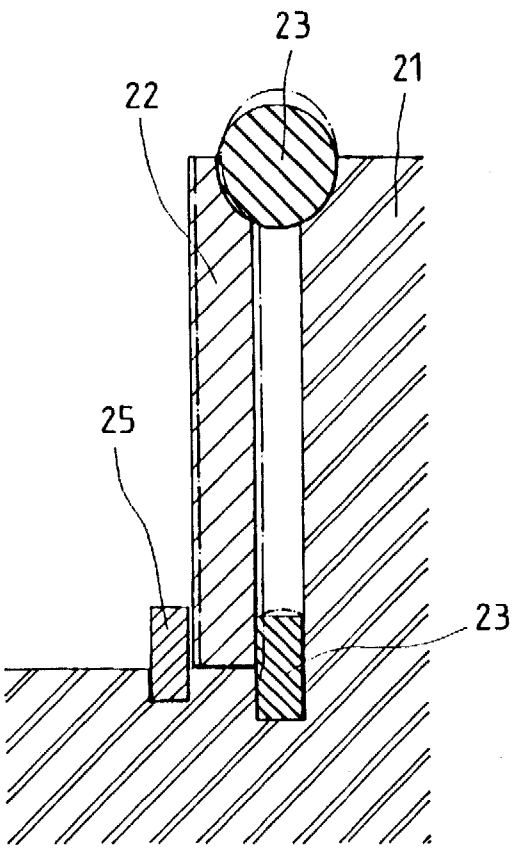
FIG. 4 shows a schematic view of the leakproof rings at work according to the present invention.
Figure 6:
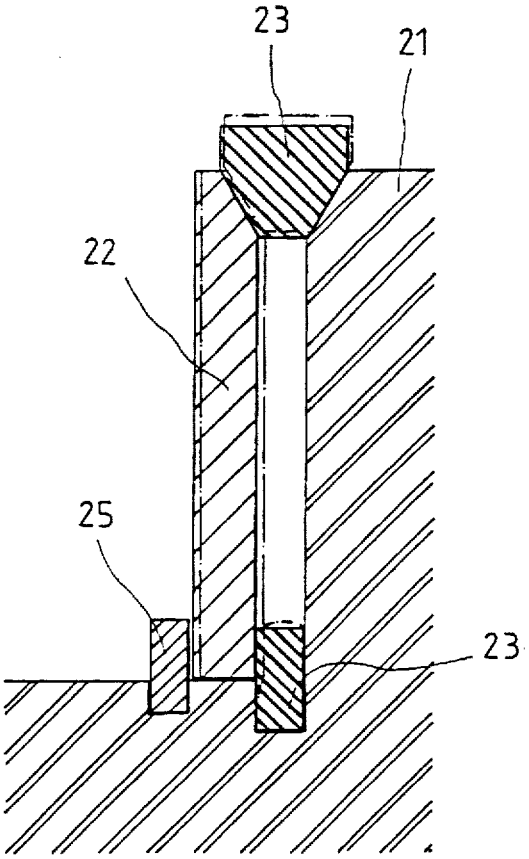
FIG. 6 shows still another schematic view of the leakproof ring at work according to the present invention.
Figure 7:
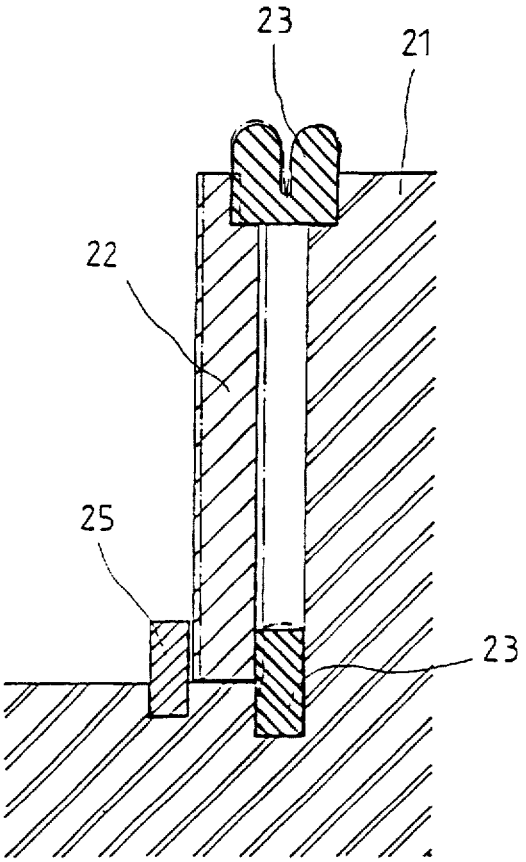
FIG. 7 shows still another schematic view of the leakproof rings at work according to the present invention.

As shown in FIG. 3, and elastic piece 26 is disposed between the driven end 21 of the action rod 20 and the pressure bearing piece 22. When the pressure bearing piece 22 is exerted on by the pressure, the elastic piece 26 is then acted on by the pressure before the leakproof ring 23 is pressed against by the pressure bearing piece 22. As a result, the action rod 20 becomes more efficient while the pressure bearing piece 22 is beteer equipped to cope with a greater burden or weight.

As illustrated in FIGS. 4–7, the leakproof ring 23 has a cross section, which may be of various geometric shapes. The leakproof ring 23 is capable of expansion at the time when it is pressed against by the pressure bearing piece 22. As a result, the leakproof ring 23 is capable of bringing about an excellent leakproof effect.

Figure 8:
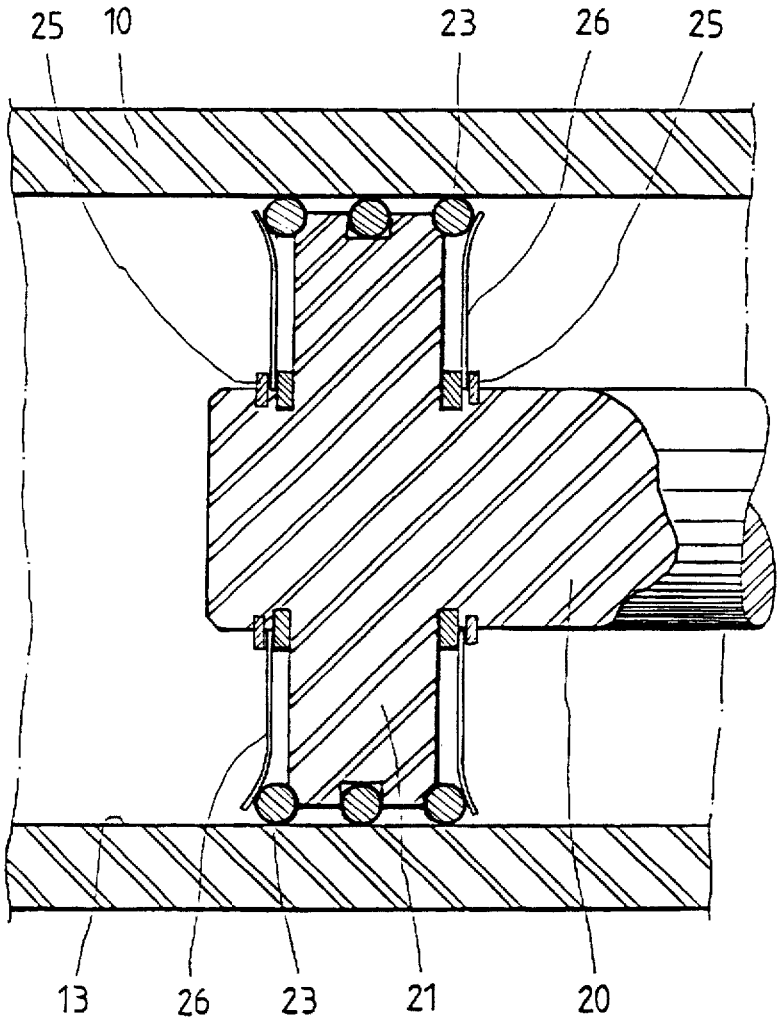
FIG. 8 shows a schematic view of the elastic piece of the present invention.

As shown in FIG. 8, the elastic piece 26 of the present invention is disposed by the leakproof ring 23. When the elastic piece 26 is deformed by the liquid or air pressure, the leakproof ring 23 is pressed against by the deformed elastic piece 26 so as to bring about an excellent leakproof effect.

The embodiments of the present invention described above are to be regarded in all respects as being merely illustrative and restrictive. Accordingly, the present invention may be embodied in other specific forms without deviating from the spirit thereof. The present invention is therefore to be limited only by the scopes of the following appended claims.

What is claimed is:

1. A heavy-load hydraulic or air cylinder comprising a main body provided therein with a piston having a pressure side and a rod side, an action rod having a driven end adjacent said piston and capable of being actuated by a liquid or air pressure to drive said action rod to move back and forth in said main body; wherein said driven end is provided respectively on both sides of said piston with at least one pressure bearing piece, said driven end and said pressure bearing pieces provided therebetween with a leakproof ring enabling a gap to be formed between said pressure bearing pieces and said driven end, said pressure bearing pieces being located by a retaining piece fastened with said action rod, said main body comprising an exit end provided with at least one of said pressure bearing pieces, an exit cap, and one of said leakproof rings located between said exit end pressure bearing piece and said exit cap; wherein said action rod is capable of moving back and forth to bring about a pushing force to act on at least one of said pressure bearing pieces before said pushing force is transferred to act on at least one of said leakproof rings; and wherein at least one of said leakproof rings is squeezed between said driven end and said pressure bearing piece to bring about a reaction force to act on an inner wall surface of said main body.

2. The heavy-load hydraulic or air cylinder as defined in claim 1, wherein said driven end of said action rod and said pressure bearing pieces are provided therebetween with an elastic piece.

3. The heavy-load hydraulic or air cylinder as defined in claim 1, wherein said leakproof rings have a polygonal cross section and are capable of expansion when exerted on by said pressure bearing pieces.

4. The heavy-load hydraulic or air cylinder as defined in claim 1, wherein at least one of said leakproof rings is provided thereby with an elastic piece capable of being deformed by the liquid or air pressure to press against said leakproof ring.

* * * * *